United States Patent [19]

Kimura

[11] Patent Number: 5,042,282

[45] Date of Patent: Aug. 27, 1991

[54] SMALL-DIAMETER METALLIC CONDUIT BENDING MACHINE

[75] Inventor: Sadao Kimura, Numazu, Japan

[73] Assignee: Usui Kokusai Sangyo Kaisha Ltd., Japan

[21] Appl. No.: 544,253

[22] Filed: Jun. 26, 1990

Related U.S. Application Data

[63] Continuation of Ser. No. 340,224, Apr. 19, 1989, abandoned.

[51] Int. Cl.[5] ..... B21D 7/024

[52] U.S. Cl. ..... 72/217; 72/306; 72/321; 72/388

[58] Field of Search ..... 72/319-321, 72/306, 215-219, 388, 381, 387, 384

[56] References Cited

U.S. PATENT DOCUMENTS

| | | | |
|---|---|---|---|
| 328,986 | 10/1885 | Warwick | 72/219 |
| 411,941 | 10/1889 | Taft | 72/218 |
| 641,535 | 1/1900 | McKibben | 72/388 |
| 1,911,028 | 5/1933 | Maxwell | 72/219 |
| 2,108,271 | 2/1938 | Samuel | 72/215 |
| 2,127,185 | 8/1938 | Parker | 72/321 |
| 2,305,850 | 12/1942 | Drysdale | 72/322 |
| 2,476,596 | 7/1949 | Green | 72/322 |
| 2,871,909 | 2/1959 | Bower | 72/321 |
| 3,732,721 | 5/1973 | Cusimano | 72/388 |
| 4,090,387 | 5/1978 | Dubreuil | 72/217 |
| 4,091,845 | 5/1978 | Johnson | 72/217 |
| 4,662,204 | 5/1987 | Saegusa . | |
| 4,735,075 | 4/1988 | Saegusa . | |
| 4,805,436 | 2/1989 | Saegusa . | |
| 4,909,059 | 3/1990 | King | 72/217 |

FOREIGN PATENT DOCUMENTS

| | | | |
|---|---|---|---|
| 136458 | 7/1952 | Sweden | 72/215 |
| 691227 | 10/1979 | U.S.S.R. | 72/217 |

*Primary Examiner*—Daniel C. Crane

*Attorney, Agent, or Firm*—Anthony J. Casella; Gerald E. Hespos

[57] ABSTRACT

A small-diameter metallic conduit bending machine includes a stationary frame. The stationary frame made of bar stock or pipe stock is shaped so as to substantially conform to a finished metallic conduit. The stationary frame includes a bending section which has in its lengthwise direction a curvature smaller than the bend radius of the metallic conduit and in its widthwise direction a guide surface substantially orthogonal to the bend plane of the metallic conduit. A bending member whose outer peripheral surface faces the guide surface is disposed movably toward the stationary frame so that the metallic conduit can be bent so as to lie along the guide surface. The bending member is moved by an actuator when the actuator is in its pulling stroke.

7 Claims, 7 Drawing Sheets

PRIOR ART

SMALL-DIAMETER METALLIC CONDUIT BENDING MACHINE

This application is a continuation of application Ser. No. 340,224, filed Apr. 19, 1989, now abandoned.

BACKGROUND OF THE INVENTION

1. Field of the Invention

This invention relates to a machine for bending a small-diameter metallic conduit at several points and more particularly, to a small-diameter metallic conduit bending machine adapted to shape a metallic conduit whose individual bend portions differ in the bend direction from one another three-dimensionally, not lying on the same plane, such as the fuel pipeline or brake pipeline of a car.

2. Description of the Prior Art

A conventional bending machine of the foregoing type includes a required number of simple bending units corresponding to the number of bend portions, each unit being configured as shown in FIG. 13 so that with respect to one bending process, a receiving roll 11 is first moved by a cylinder 12 to come into contact with a metallic conduit 13, and then a bending roll 14 is moved by a cylinder 15 to bend the metallic conduit 13. In the drawing, 16 and 17 are mounts, 18 and 19 are stays, and 20 is a base.

According to the foregoing conventional bending machine, however, since the bending process is carried out by moving the receiving roll 11 and the bending roll 14 by means of the respective cylinders 12 and 15, one bending process needs two actions; thus, the processing time is long. Since the bending process is completed when the piston rods of both cylinders 12 and 15 are in an extended state, upon supply of a pressurized fluid into the cylinder (generally, an air cylinder) at the time of bending, the bending moment imposed on the piston rod increases, and flexure resulting from the reaction caused at the time of bending appears in the stays 18 and 19 and mounts 16 and 17 for supporting the cylinders 12 and 15; as a result, a minute discrepancy (called "breathing" by those skilled in the art) occurs between the receiving roll 11 and the bending roll 14, thereby resulting in variations in products. To eliminate such a discrepancy, it is necessary to make the stays 18 and 19 and the mounts 16 and 17 thick and rigid; consequently, the machine becomes large in size and heavy in spite of such provisions however, some discrepancy cannot be removed. Further, since the whole machine is designed and composed while giving consideration to the position, orientation, etc. of each of the cylinders 12 and 15, receiving roll 11 and bending roll 14, a long time is needed for manufacture, such as assembly and adjustment; as a result, the machine cannot be put in service in time where the start of mass production is settled. In addition, since the number of parts and of moving portions is large, the manufacturing cost is very high and the durability is inferior.

SUMMARY OF THE INVENTION

Therefore, it is the object of the present invention to prevent the occurrence of discrepancy (breathing) primarily, thus to provide a bending machine capable of completing one bending process through one action to shorten the processing time, which is small in size, light in weight, low in cost, and easy to manufacture.

To achieve the foregoing object, according to a first feature of the present invention, a small-diameter metallic conduit bending machine comprises a stationary frame which is formed by connecting bar stock or pipe stock into a shape substantially conforming to the finished curved shape of a metallic conduit over the whole length, a bending section of the machine has in its lengthwise direction a curvature smaller than the bend radius of the metallic conduit and in its widthwise direction a guide surface defined by a surface substantially orthogonal to the bend plane of the metallic conduit, and a bending member which has an outer peripheral surface facing the guide surface is movable toward the stationary frame so that the metallic conduit can be bent so as to lie along the guide surface; according to a second feature, it comprises a stationary frame which is formed by connecting bar stock or pipe stock into a shape substantially conforming to the finished curved shape of a metallic conduit over the whole length, a bending section of the machine has a guide surface defined by a surface substantially parallel to a bend plane, a guide member is provided on the stationary frame in a direction substantially orthogonal to the guide surface and has a curvature smaller than the bend radius of the metallic conduit, a bending member is movable toward the stationary frame so that the metallic conduit can be bent so as to lie along the guide surface and the guide member; and according to a third feature, it comprises a stationary frame which is formed by connecting bar stock or pipe stock into a shape substantially conforming to the finished curved shape of a metallic conduit over the whole length, at least one first bending station is provided in the stationary frame which has in its lengthwise direction a curvature smaller than the bend radius of the metallic conduit and in its widthwise direction a first guide surface defined by a surface substantially orthogonal to the bend plane of the metallic conduit, at least one second bending station is provided in the stationary frame which has a second guide surface defined by a surface substantially parallel to the bend plane and includes a guide member provided on the stationary frame in a direction substantially orthogonal to the second guide surface and having a curvature smaller than the bend radius of the metallic conduit, a first bending member is movable toward the stationary frame so that the metallic conduit can be bent so as to lie along the first guide surface in the first bending station, and a second bending member is movable toward the stationary frame so that the metallic conduit can be bent so as to lie along the second guide surface and the guide member in the second bending station.

It is preferable that each bending member be moved by an actuator attached to the stationary frame, that the stationary frame formed by connecting the bar stock or pipe stock through welding be quadrangular in cross section, that the guide member be shaped like a plate piece or a block, and that the bending member be made of a roll which is driven by an air cylinder or rotary actuator.

As will be appreciated from the foregoing, the present invention performs bending by the use of the stationary frame with the guide surface and the bending member which is moved from outside the guide preferably by the actuator, such as air cylinder or rotary actuator, attached to the frame directly or via a post or bracket. Therefore, since the actuator for moving the bending member is coupled to the stationary frame by welding or the like, flexure is prevented from appearing in a stay or the like. Since bending is carried out preferably when the piston rod of the air cylinder is in a pulling stroke not in a pushing stroke (in an extended state), in contrast to the prior art, no appreciable bending moment is imposed on the piston rod or the like at the termination of each bending process, so that the influence of looseness of a bush provided for the piston rod becomes minimum; thus, any minute discrepancy (breathing) in relation to the bending member can be prevented from occurring. Further, since one bending process is completed through one action, the processing time is shortened. Since the frame is readily formed by welding or the like and the bending member (inclusive of the actuator) is simply disposed so as to face the frame, the machine can be made small in size and light in weight.

BRIEF DESCRIPTION OF THE DRAWINGS

FIG. 7(*a*) is an enlarged view showing an important portion of FIG. 7;

DETAILED DESCRIPTION OF THE PREFERRED EMBODIMENTS

Figure 1:
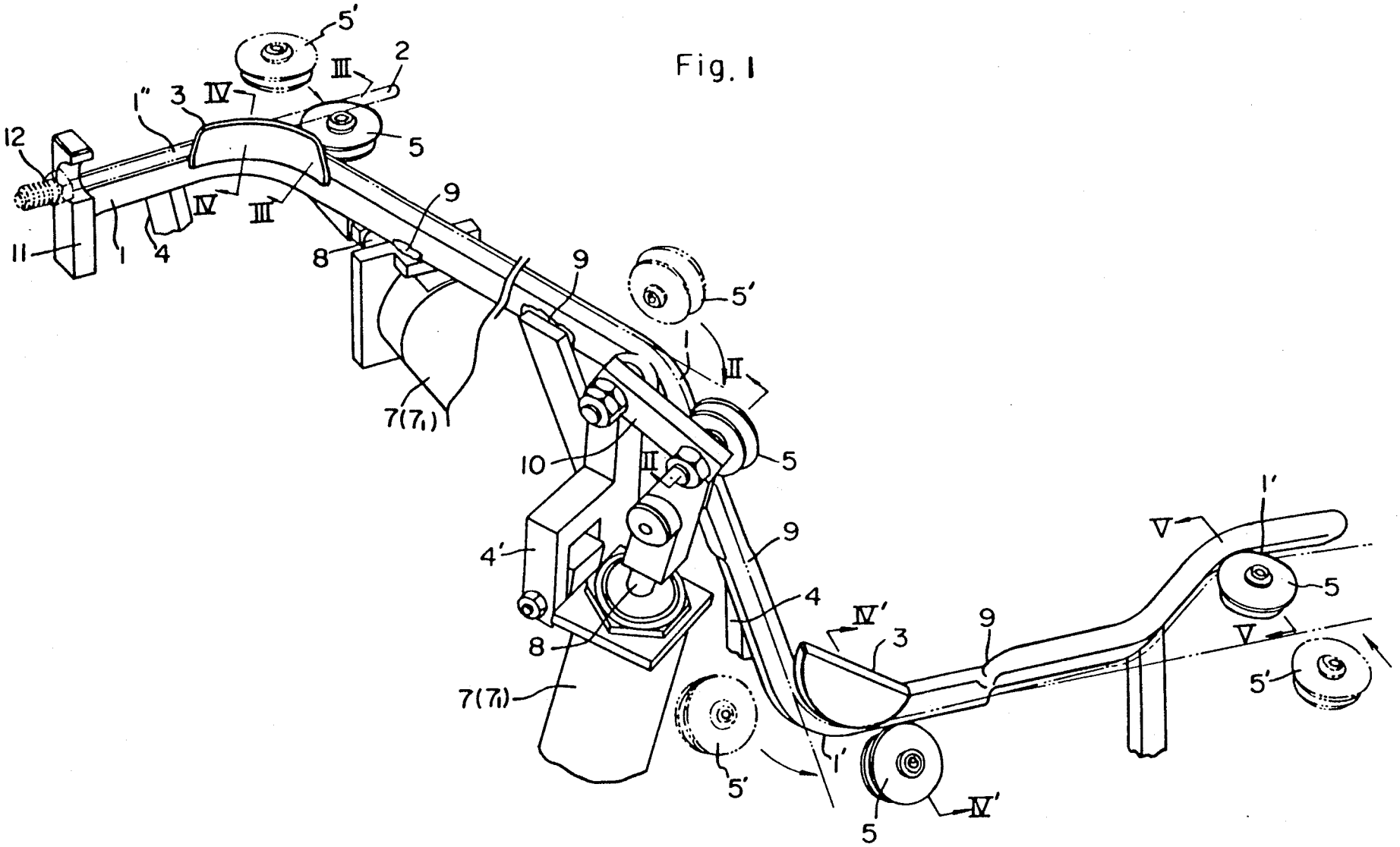
FIG. 1 is a fragmentary perspective view showing an embodiment of a small-diameter metallic conduit bending machine according to the present invention.
Figure 2:
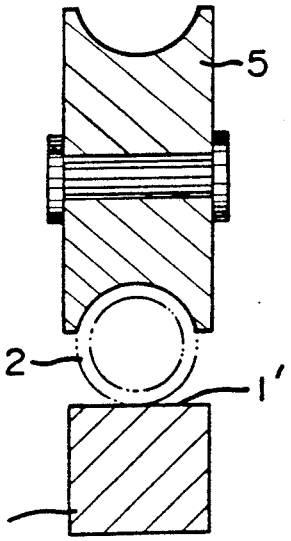
FIG. 2 is an enlarged sectional view taken in the direction of the arrows along line II—II of FIG. 1.
Figure 3:
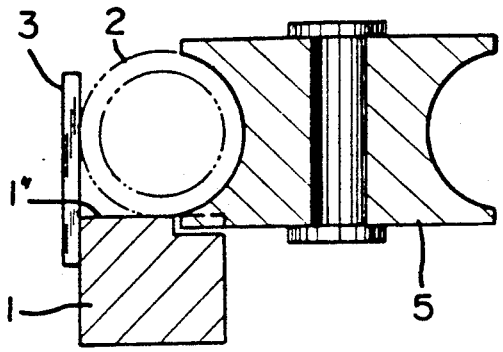
FIG. 3 is an enlarged sectional view taken in the direction of the arrows along line III—III of FIG. 1.
Figure 4B:
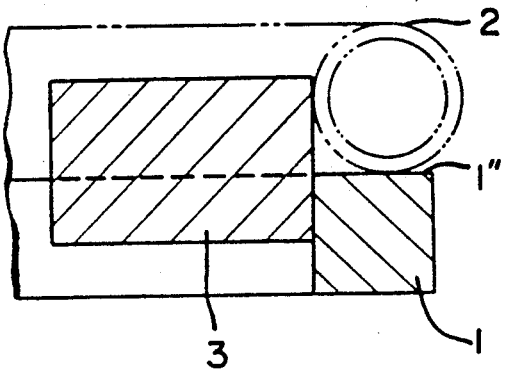
FIGS. 4(*a*) and 4(*b*) are enlarged sectional views taken in the directions of the arrows along line IV—IV and line IV'—IV', respectively, of FIG. 1.
Figure 4A:
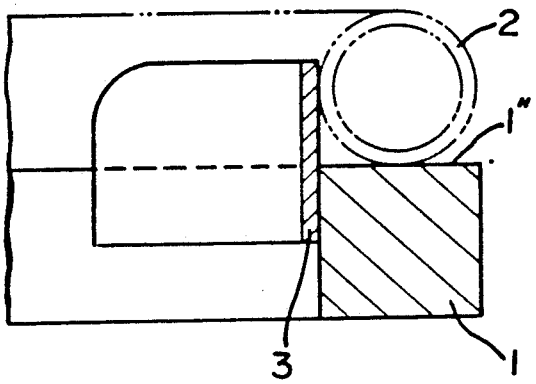
Figure 5:
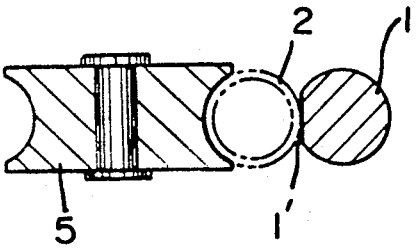
FIG. 5 is an enlarged sectional view taken in the direction of the arrows along line V—V of FIG. 1.

In FIGS. 1 through 12, reference numeral 1 designates an elongate stationary frame made of bar stock (see FIGS. 2 through 5), pipe stock (see FIGS. 6 through 8), or the like in continuous form by welding 9, which substantially conforms in curved shape to a metallic conduit 2 over the whole length and has a first surface 1' defined by a surface whose widthwise direction is substantially orthogonal to a bend plane and a second guide surface 1'' defined by a surface whose widthwise direction is substantially parallel to the bend plane in the vicinity of a bending section, preferably within the range of bend angle, the sectional contour of the frame including a flat portion and preferably being made substantially quadrangular in cross section. However, the sectional shape of the second guide surface 1'' is not necessarily limited to the above, but may take a circular shape; in this latter case, the second guide surface 1'' means a surface which extends in a direction substantially orthogonal to a guide member 3 hereinafter described and is formed by lines tangential to the outer peripheral surface of the metallic conduit 2. At a given position in relation to the frame 1 effective in bending the metallic conduit 2, there is a guide member 3 which has a curvature smaller than the bend radius of the metallic conduit 2 and is secured by welding or the like in a direction substantially orthogonal to both the first guide surface 1' and the second guide surface 1''. The curvature and shape of each of the first guide surface 1', second guide surface 1'', guide member 3, frame 1, etc. are determined in consideration of the spring back of the metallic conduit 2 occurring at the time of bending. Here, the guide member 3 may be shaped like a plate piece as shown in FIG. 4(*a*) or like a block as shown in FIG. 4(*b*). Although the frame 1 illustrated is secured on a basement 6 by a required number of posts 4, according to the present invention, the basement 6 is not necessarily required if the posts 4 are connected together, in contrast to the prior art. 5 designates a bending member which is disposed as being able to move toward the stationary frame 1 while pressing the metallic conduit 2 so as to lie along the first guide surface 1' or second guide surface 1'' and the guide member 3. In FIG. 2, the bending member for performing bending in cooperation with the first guide surface 1' is disposed so that its peripheral surface faces the first guide surface 1'. In FIG. 3, the bending member 5 for performing bending in cooperation with the second guide surface 1'' and the guide member 3 is disposed so that its moving direction is substantially parallel to the second guide surface 1'' or intersects therewith with a slight inclination. 5' designates the bending member located at a position before the bending process. The bending member 5 is a member being moved straightly from outside the guide member 3 by a piston rod 8 (see FIG. 9) or circularly via a swinging lever 10 (see FIG. 10) upon the actuation of an actuator 7 (represented by an air cylinder $7_1$ in FIG. 1) attached to the frame 1 so that the metallic conduit 2 can be bent so as to lie along the first guide surface 1' or second guide surface 1'' and the guide member 3.

Figure 6:
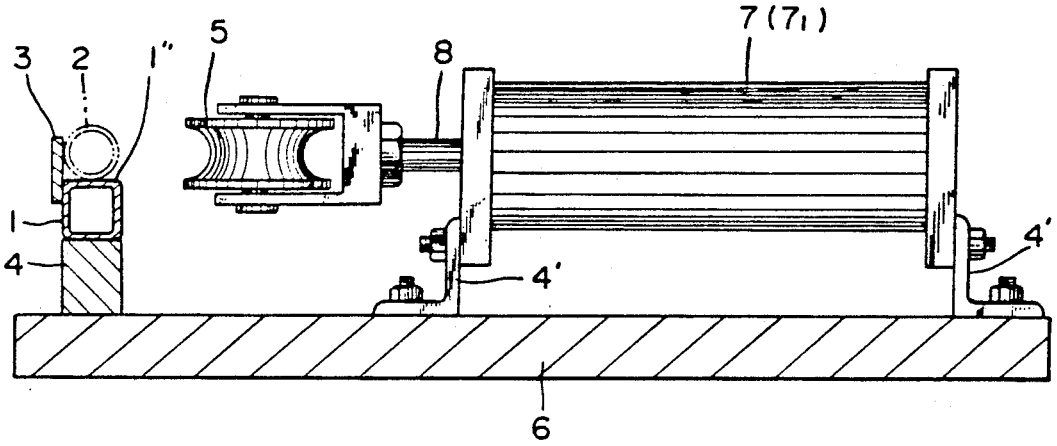
FIG. 6 is a sectional view showing another embodiment of the present invention.
Figure 7:
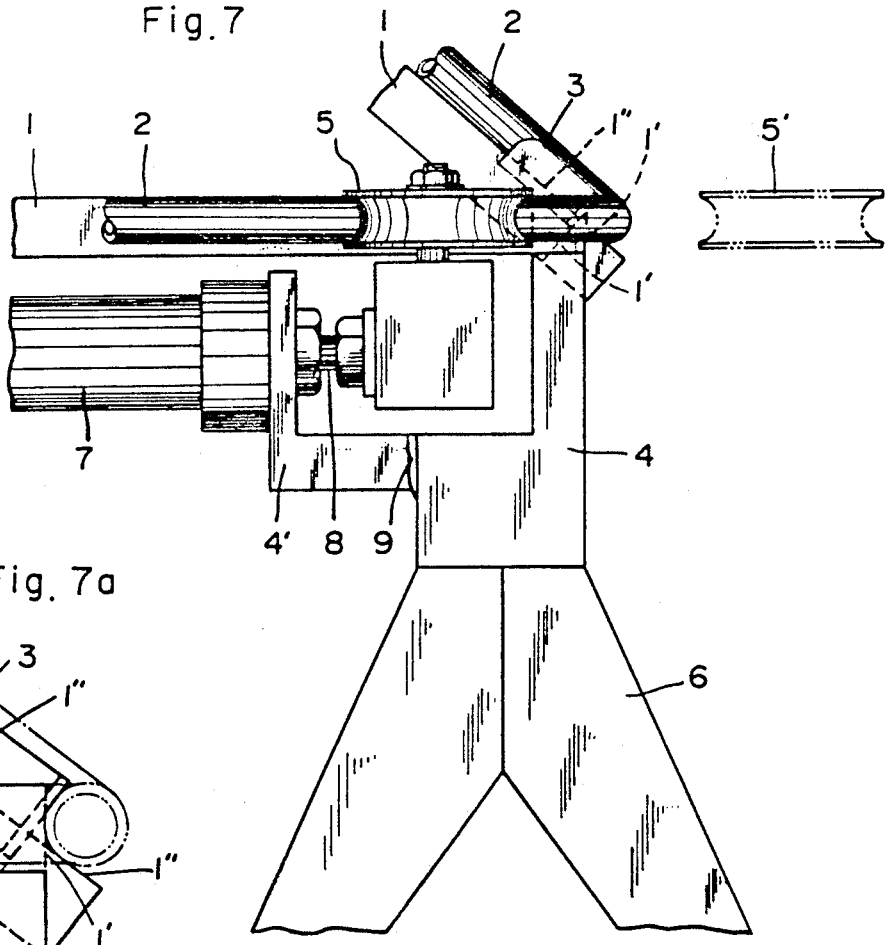
FIG. 7 is a sectional view showing still another embodiment of the present invention.
Figure 7A:
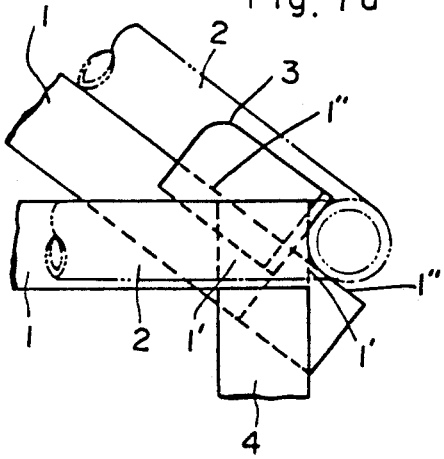
Figure 8:
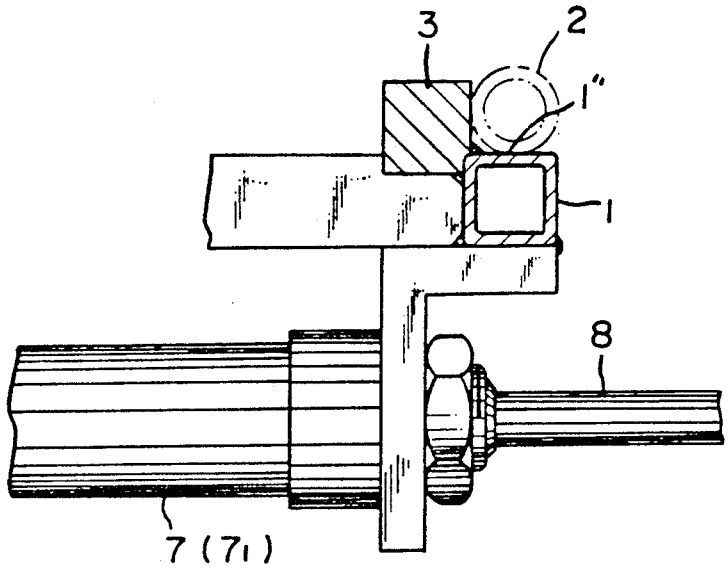
FIGS. 8 through 10 are views showing the attached state of an actuator.
Figure 9:
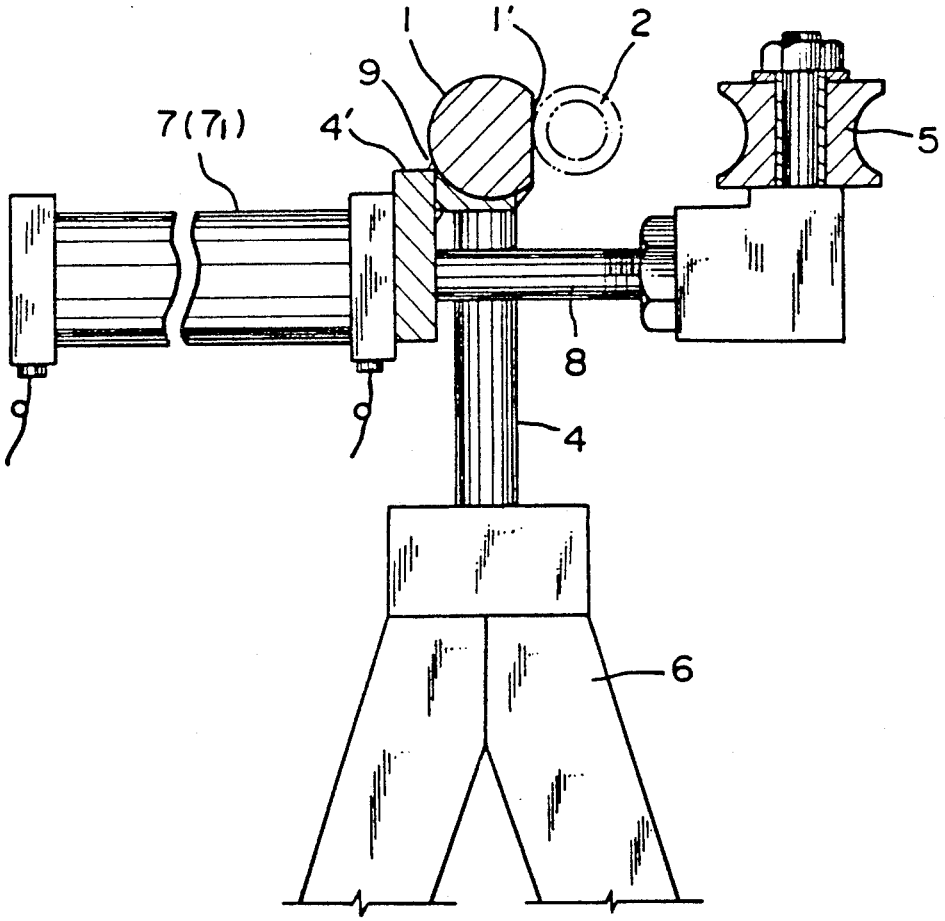
Figure 10:
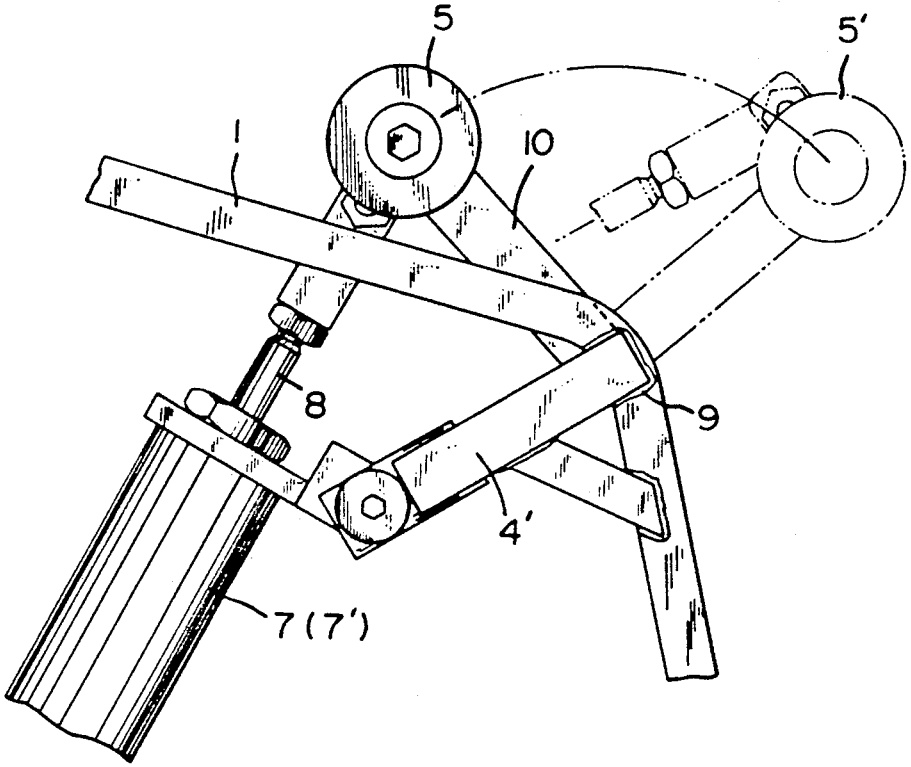
Figure 12:
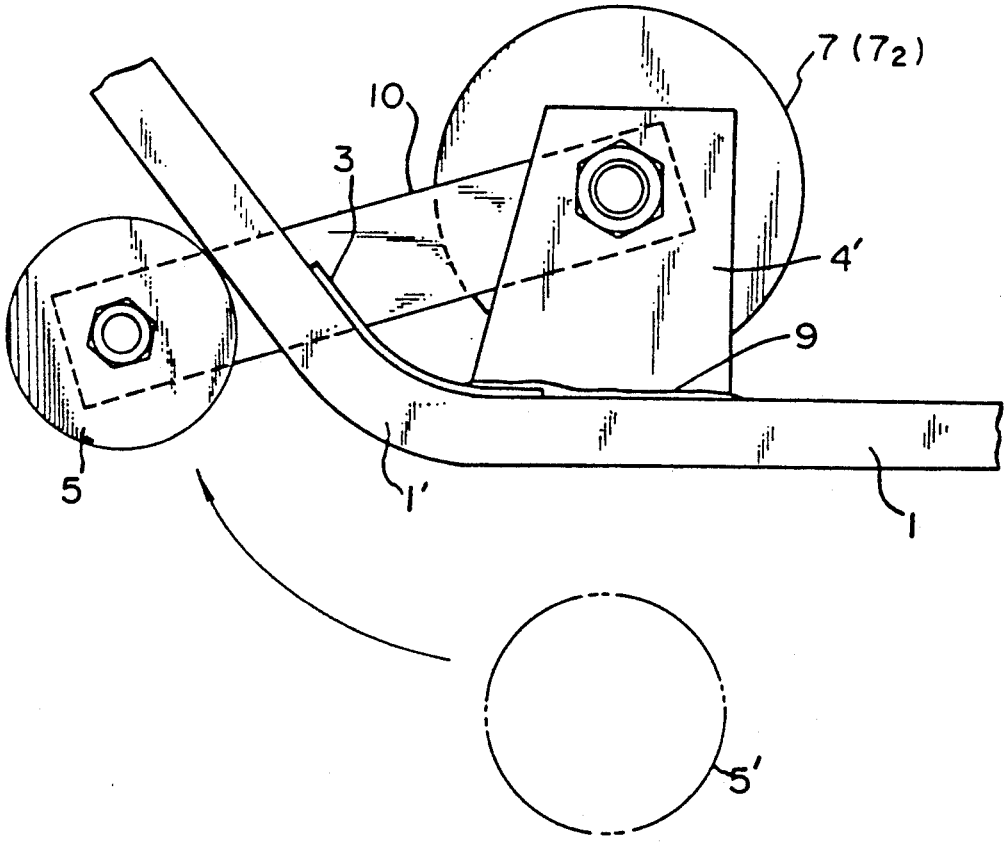
FIGS. 11 and 12 are front views showing other embodiments of the present invention.
Figure 11:
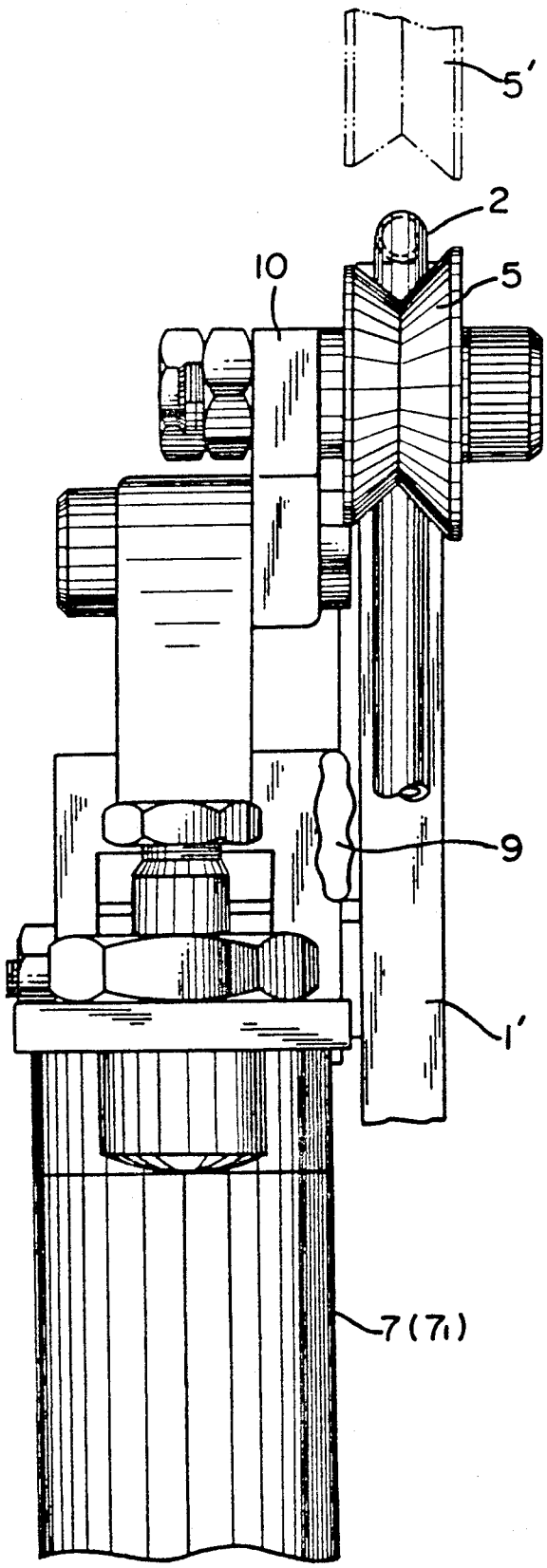
Figure 13:
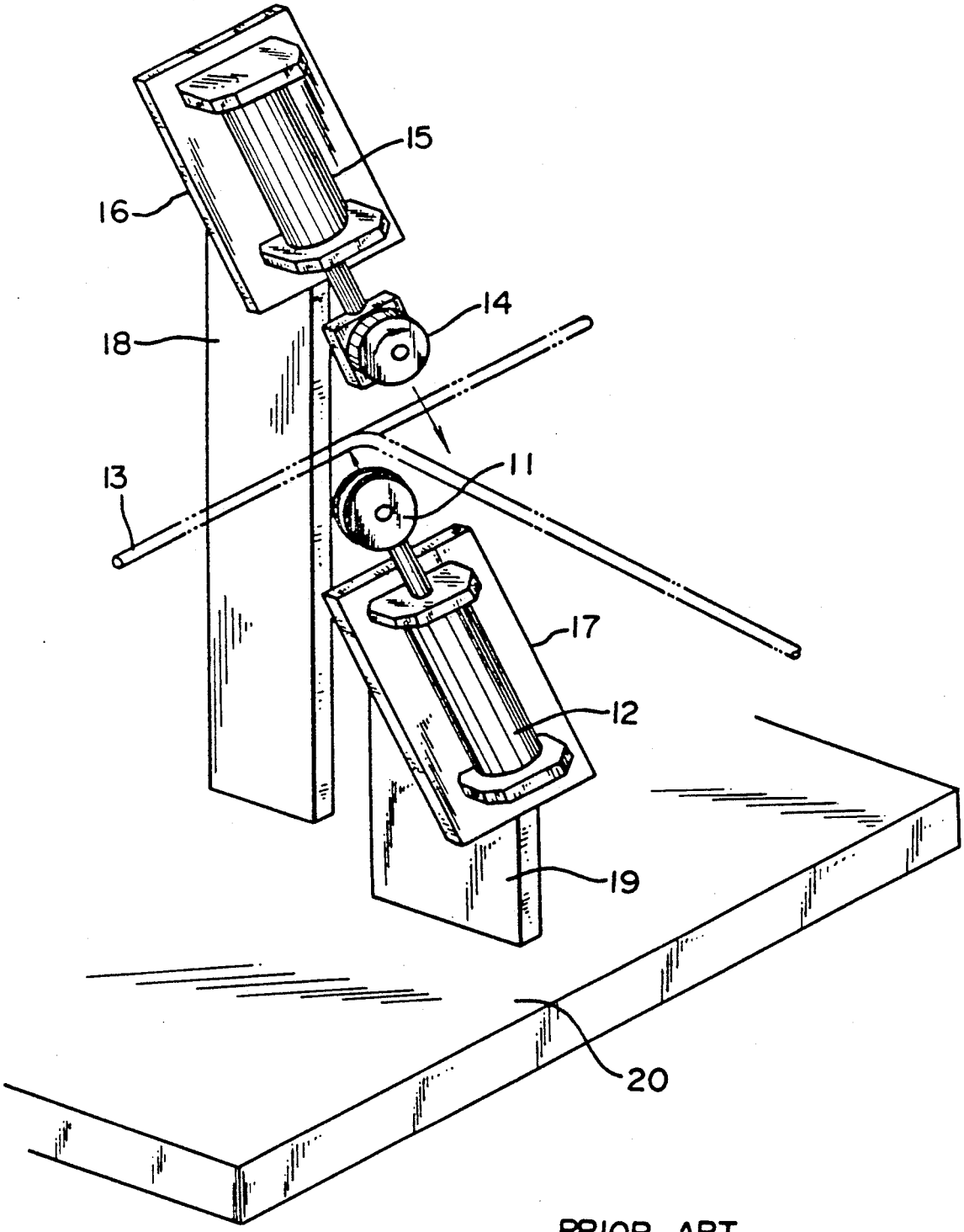
FIG. 13 is a perspective view showing a conventional bending machine.

Although it is preferable that the bending member 5 be moved by the actuator 7 attached to the frame 1 as in the foregoing embodiments, it is also possible as shown in FIG. 6 to secure the actuator 7 to brackets 4' and 4' rigidly mounted on the basement 6 and to cause the piston rod 8 to extend so that the bending member 5 attached to the distal end of the piston rod can perform bending.

Where the bending member 5 is to be moved straightly, as shown in FIGS. 1, 7, 8 and 9 (except for the embodiment of FIG. 6), the actuator 7 is secured to the frame 1 directly or via the post 4 or bracket 4' to fix its axial line in a certain direction. Where the bending member 5 is to be moved circularly, as shown in FIGS. 1 and 10, the actuator 7 is pivoted to the bracket 4' at its supporting portion so that its axial line can move. In either case, it is important that the actuator 7 should be rigidly attached to the frame 1 directly or via the post 4 or bracket 4' by welding 9 or the like. In addition, the bending member 5 is arranged so as to move from outside the guide surface 1' or guide member 3 toward the frame 1 in response to the pulling movement of the piston rod 8. The foregoing manners of attaching the actuator and moving the bending member are selected depending on the interference circumstances with the metallic conduit 2 which differs in shape before and after bending. It should be noted that the actuator 7 for driving the bending member 5 can be, other than the air cylinder $7_1$ already illustrated, a rotary actuator $7_2$ as shown in FIG. 12, or a rack-pinion mechanism not shown. Further, the contacting portion of the bending member 5 with the metallic conduit 2 may be of, other than the circular contact type described above, a two-point contact/angular groove type as shown in FIG. 11.

In performing the bending of the metallic conduit 2, first, one end of the straight metallic conduit 2 is locked and secured to a lock member 11 disposed at one end of the stationary frame 1 by means of an end fixture 12 (a first mode), or a given point of an intermediate portion of the conduit that is indexed using a stopper or the like (not shown) is secured by a clamp tool or the like (a second mode). Then, the bending process is carried out, from the secured end side toward the free end side in the first mode, or from the secured portion toward both free ends in the second mode, by causing the straight movement of the bending member 5 toward the frame 1 or the circular movement thereof progressively so that the metallic conduit 2 can be pressed so as to lie along the first guide surface 1' or second guide surface 1'' and the guide member 3 of the frame 1. Of course, the machine of the present invention can be used in bending not only metallic conduit, but also bar stock.

As described in greater detail, according to the present invention, the bending process is carried out by means of the bending member 5 which is moved from outside the guide member 3 preferably by the actuator 7 attached to the frame 1 directly or via the post 4 or bracket 4' so that the metallic conduit 2 can be bent so as to lie along the guide member 3 and the first guide surface 1' or second guide surface 1'' of the stationary frame 1. Therefore, since the actuator 7 for moving the bending member 5 is coupled to the stationary frame 1, flexure is prevented from appearing in the stay or the like. Further, since the bending member 5 is actuated preferably when the actuator 7 is pulling its piston rod, the influence of looseness of a bush provided for the piston rod that becomes worse when the piston rod is pushing or in an extended state is reduced minimum, in contrast to the prior art; thus, it is possible to nearly prevent the imposition of the bending moment. Therefore, it is possible to prevent any minute discrepancy (breathing) from occurring between the bending member 5 and the guide member 3, thus to fabricate curved products of high preciseness. Further, since one bending process is completed through one action, the processing time is shortened. Further, the whole bending machine is composed simply by cutting a square bar or the like on the market to given lengths, bending, and welding together into a continuous shape so as to substantially conform to the finished curved shape of the metallic conduit over the whole length, by providing the plate-like guide member 3 at a given position to complete the frame 1, and by disposing the bending member 5 (inclusive of the actuator 7) so that it can move toward the frame; accordingly, as compared with the prior art, the number of parts is remarkably decreased; hence, the machine can be made small in size, light in weight, and low in cost. Further, since the machine can be manufactured in a very short time, it can be surely put in a serviceable state before the start of mass production.

What is claimed is:

1. A small-diameter metallic conduit bending machine for forming a conduit into a finished curved shape defined by at least first and second curves which define first and second angularly aligned bend planes respectively, said bending machine comprising:

a frame having a shape substantially conforming to the finished curved shape of the metallic conduit over the whole length, the shape of said frame being of a rigid construction, at least one first bending station provided in said frame comprising an elongated first guide surface which in its lengthwise direction defines a curvature smaller than the bend radius of the first curve of the metallic conduit and in its widthwise direction extends substantially orthogonal to the first bend plane of the metallic conduit, at least one second bending station provided in said frame which has a second guide surface defined by a surface substantially parallel to the second bend plane and includes a guide member provided on said frame and disposed in a direction substantially orthogonal to said second guide surface and having a curvature smaller than the bend radius of the second curve of the metallic conduit, a first bending member which is mounted radially outwardly from the curvature of the first guide surface and which is movable toward said the first guide surface of frame so that the metallic conduit can be bent so as to lie along the curvature of said first guide surface in said first bending station, and a second bending member which is mounted radially outwardly from the guide member of the second bending station and which is movable toward the guide member of said stationary frame so that the metallic conduit initially can be bent toward the second bending station by the first bending member, and then can be bent by the second bending member so as to lie along said second guide surface and said guide member in said second bending station whereby the mounting of the second bending member radially outwardly from the guide member of the second bending station enables the metallic conduit to be urged toward the second bending station by the first bending member for subsequent bending by the second bending member, said first and second bending members being oriented on said frame so that bending is performed at both said first and second bending stations while said first and second bending members are fixed to said frame.

2. A small-diameter metallic conduit bending machine according to claim 1, wherein said first bending member and said second bending member are moved by respective actuators attached to said stationary frame.

3. A small-diameter metallic conduit bending machine according to claim 1, wherein said frame is formed from bar stock or pipe stock which is substantially quadrangular in cross section.

4. A small-diameter metallic conduit bending machine according to claim 1, wherein said bar stock or said pipe stock is connected by welding.

5. A small-diameter metallic conduit bending machine according to claim 1, wherein said guide member is shaped like a plate piece or a block.

6. A small-diameter metallic conduit bending machine according to claim 1, wherein said first or second bending member is made of a roll which is driven by an air cylinder or rotary actuator.

7. A small-diameter metallic conduit bending machine for forming a conduit into a finished curved shape defined by at least first and second curves which define first and second angularly aligned bend planes respectively, said bending machine comprising:

a frame which is formed by connecting bar stock or pipe stock into a shape substantially conforming to the finished curved shape of a metallic conduit over the whole length, the shape of said bar stock or pipe stock being of a rigid construction, at least one first bending station provided in said frame comprising an elongated first guide surface which in its lengthwise direction defines a curvature smaller than the bend radius of the first curve of the metallic conduit and in its widthwise direction extends substantially orthogonal to the first bend plane of the metallic conduit, at least one second bending station provided in said frame which has a second guide surface defined by a surface substantially parallel to the second bend plane and includes a guide member provided on said frame and disposed in a direction substantially orthogonal to said second guide surface and having a curvature smaller than the bend radius of the second curve of the metallic conduit, a first bending member which is moved toward the first guide surface of said frame from thereoutside by an actuator attached to said frame so that the metallic conduit can be bent so as to lie along said first guide surface in said first bending station, and a second bending member which is moved toward the guide member in the second bending station of said frame from thereoutside by an actuator attached to said frame so that the metallic conduit initially can be bent toward the second bending station by the first bending member, and then can be bent by the second bending member so as to lie along said second guide surface and said guide member in said second bending station, whereby the mounting of the second bending member radially outwardly from the guide member of the second bending station enables the metallic conduit to be urged toward the second bending station by the first bending member for subsequent bending by the second bending member, said first and second bending members being oriented on said frame so that bending is performed at both said first and second bending stations while said first and second bending members are fixed to said frame.

* * * * *